US005141565A

United States Patent [19]

Kramer et al.

[11] Patent Number: 5,141,565

[45] Date of Patent: Aug. 25, 1992

[54] PROCESS FOR ANNEALING COLD WORKING UNALLOYED TITANIUM

[75] Inventors: Karl-Heinz Kramer, Mülheim-Ruhr; Heinz-Jürgen Osing, Iserlohn, both of Fed. Rep. of Germany

[73] Assignee: Stahlwerk Ergste GmbH & Co. KG, Schwerte, Fed. Rep. of Germany

[21] Appl. No.: 635,765

[22] Filed: Dec. 28, 1990

[30] Foreign Application Priority Data

Jan. 8, 1990 [DE] Fed. Rep. of Germany ..... 4000270

[51] Int. Cl.[5] ..... C22C 14/00

[52] U.S. Cl. ..... 148/670; 148/421

[58] Field of Search ..... 148/11.5 F, 133, 421

[56] References Cited

U.S. PATENT DOCUMENTS 3,496,755 2/1970 Guernsey et al. ..... 148/11.5 F
3,649,374 3/1972 Chalk ..... 148/11.5 F
3,969,155 7/1976 McKeighen ..... 148/11.5 F
4,581,077 4/1986 Sakuyama et al. ..... 148/11.5 F
4,886,559 12/1989 Shindo et al. ..... 148/11.5 F

FOREIGN PATENT DOCUMENTS 1079331 4/1960 Fed. Rep. of Germany .
2204061 11/1988 United Kingdom .

OTHER PUBLICATIONS

"*Titanium*" (A Technical Guide), Matthew J. Donachie, Jr., pp. 57–73, 1988.

*Primary Examiner*—Upendra Roy
*Attorney, Agent, or Firm*—Akoo-Toren

[57] ABSTRACT

In a process for cold forming unalloyed titanium high strength and ductility, in particular high bendability, are obtained if the material is subjected to intermediate annealing at a temperature of up to 500° C.

15 Claims, 4 Drawing Sheets

Influence of final annealing temperature on the mechanical properties of cold deformed titanium, grade 2, hot rolled condition $R_m = 557$ N/qmm, $A_{50} = 27\%$.

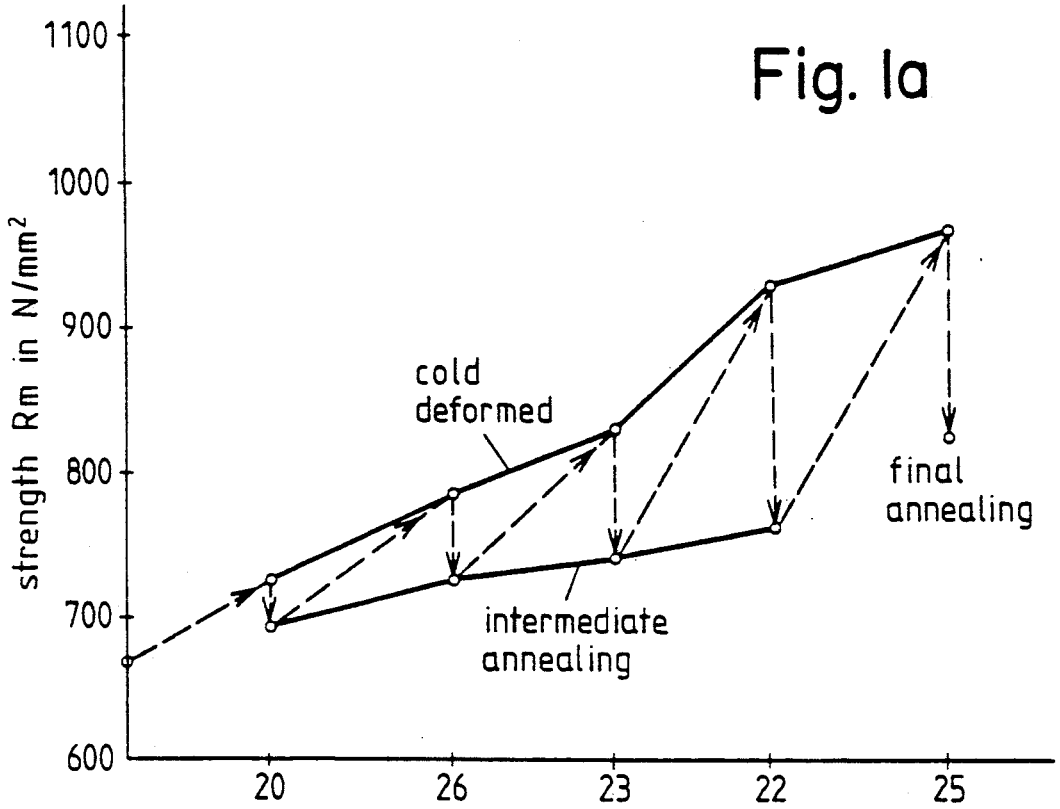
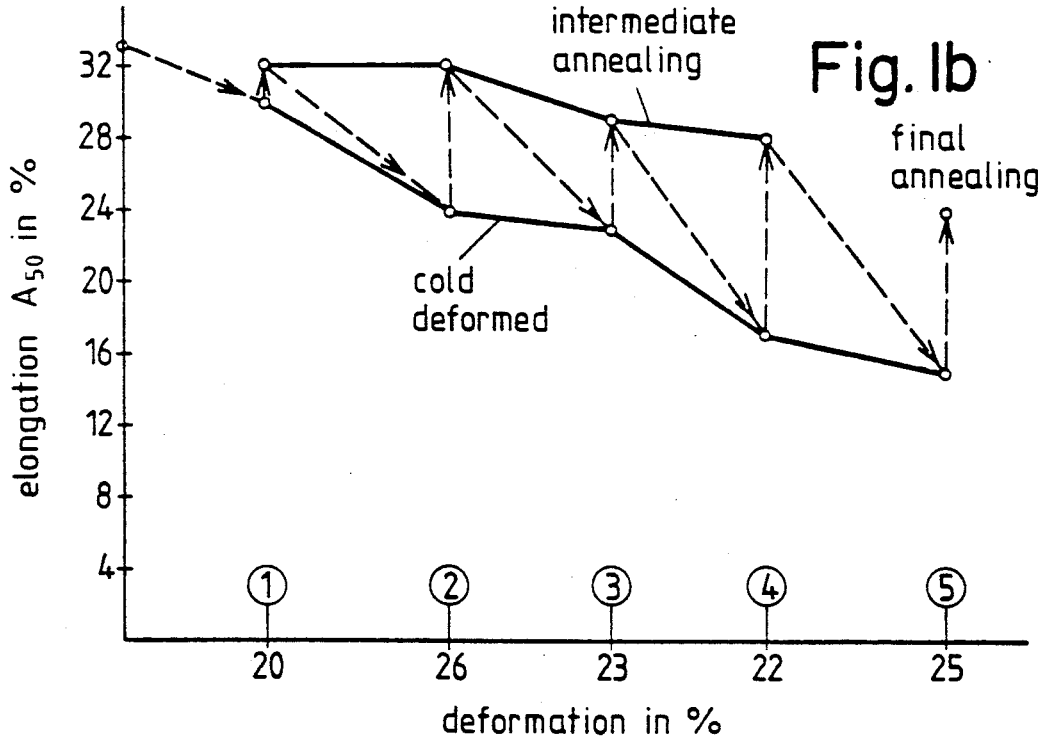
Figs. Ia & Ib: Rolling of a titanium section, grade 4, to 17.5 x 5.2 mm with 4 intermediate annealings and 1 final annealing.

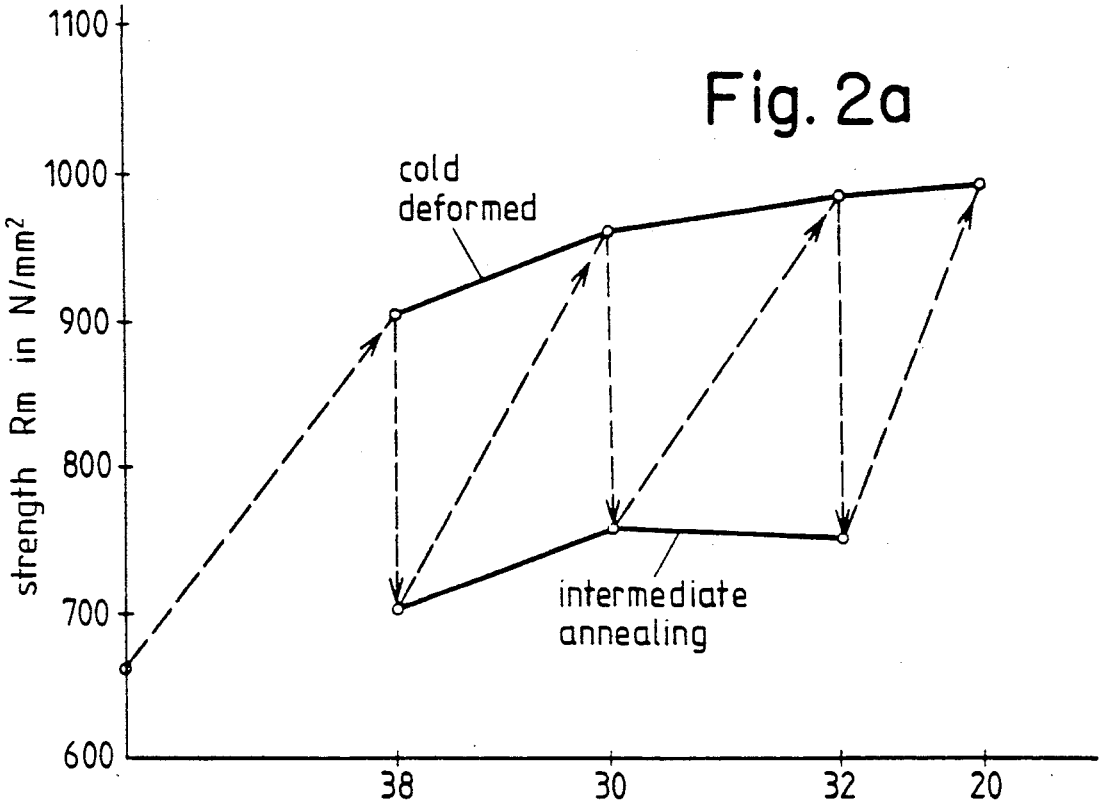
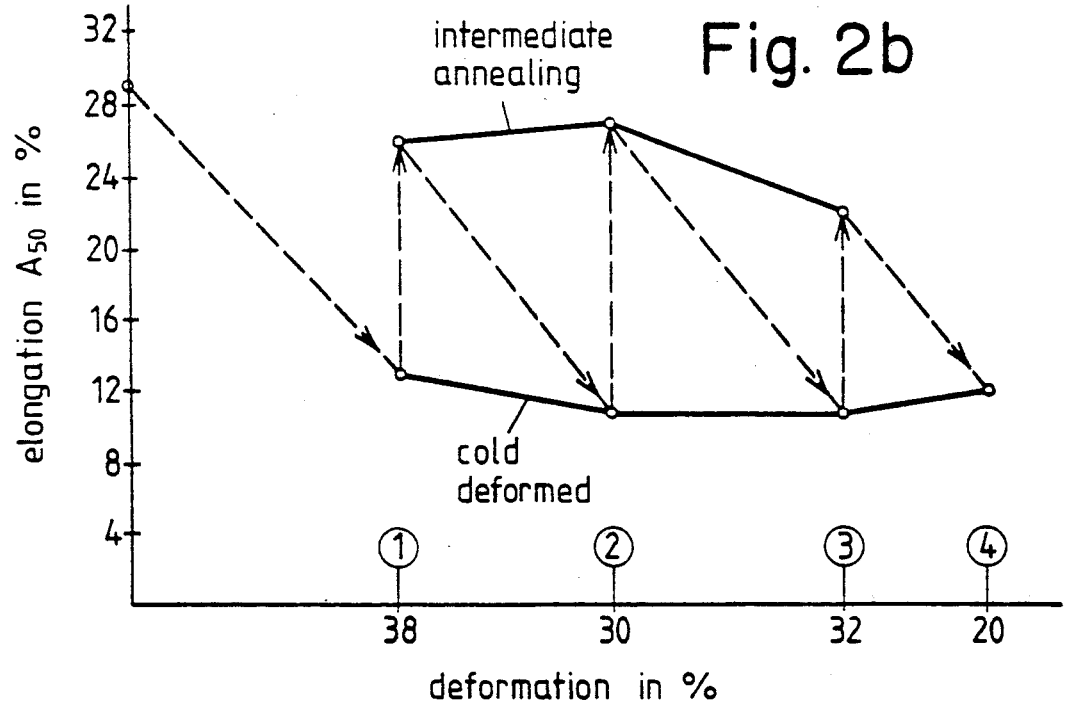
Figs. 2a & 2b: Rolling of a titanium section, grade 4, to 8.1 x 3.3 mm with 3 intermediate annealings and 1 final annealing.

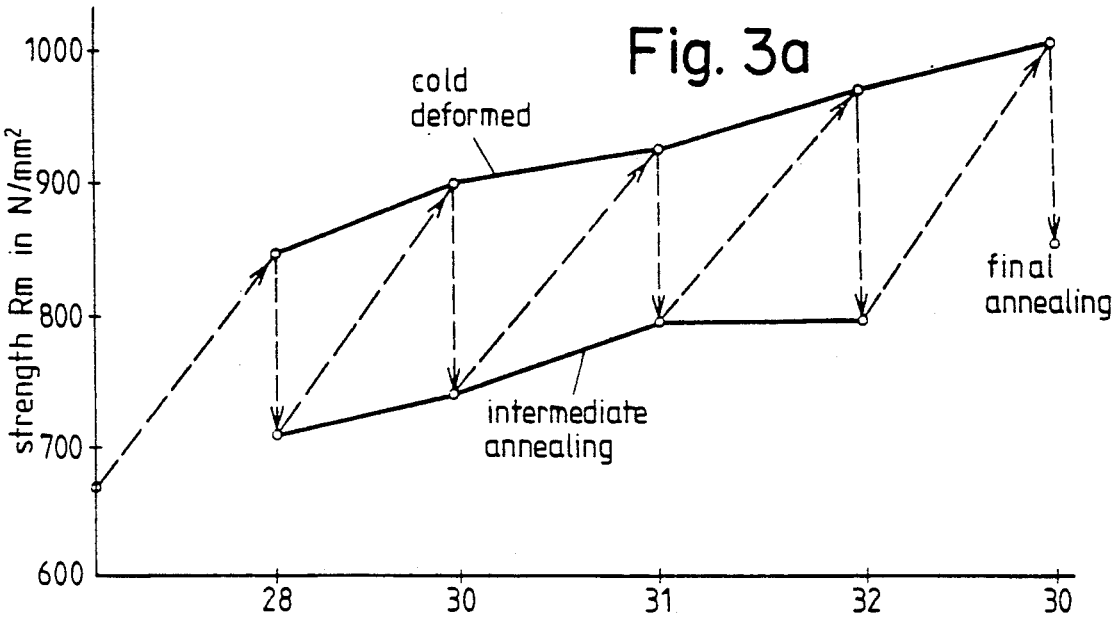
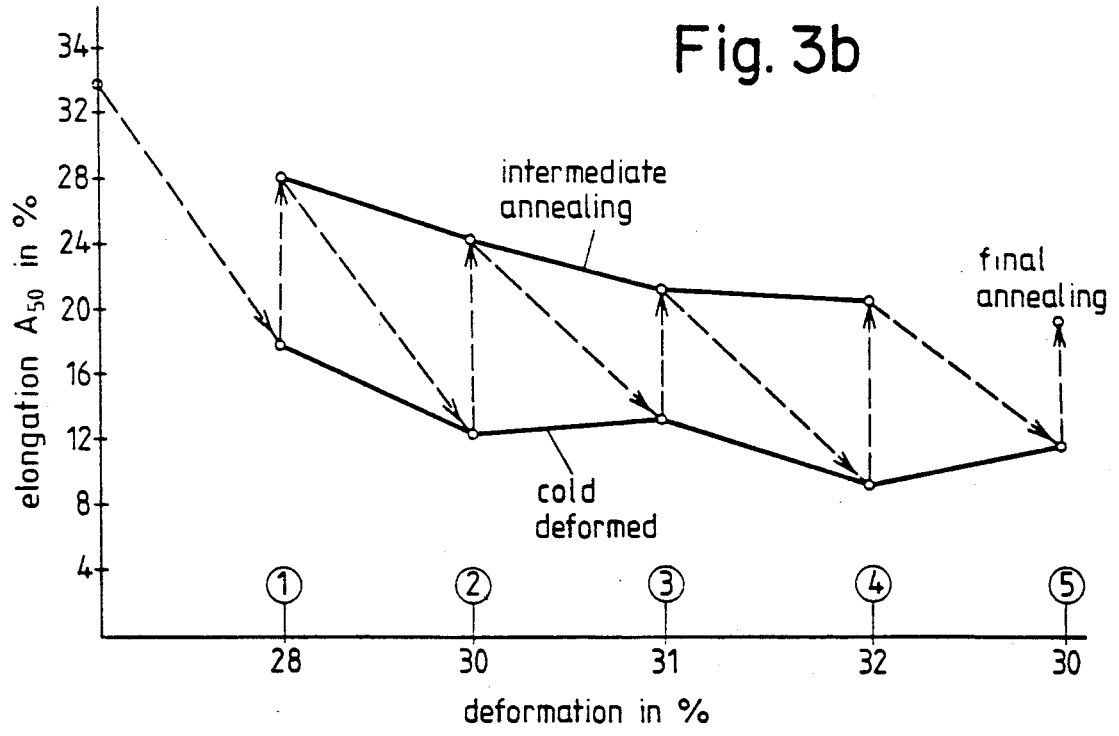
Figs.3a&3b: Drawing of a titanium wire, grade 4, to 8mm diameter with 4 intermediate annealings and 1 final annealing.

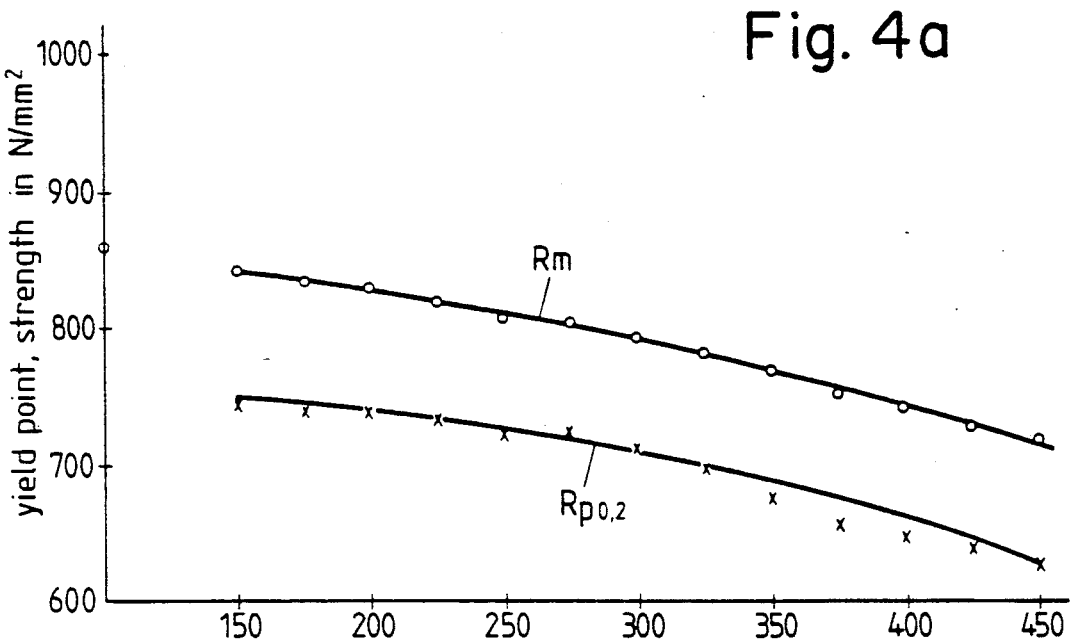
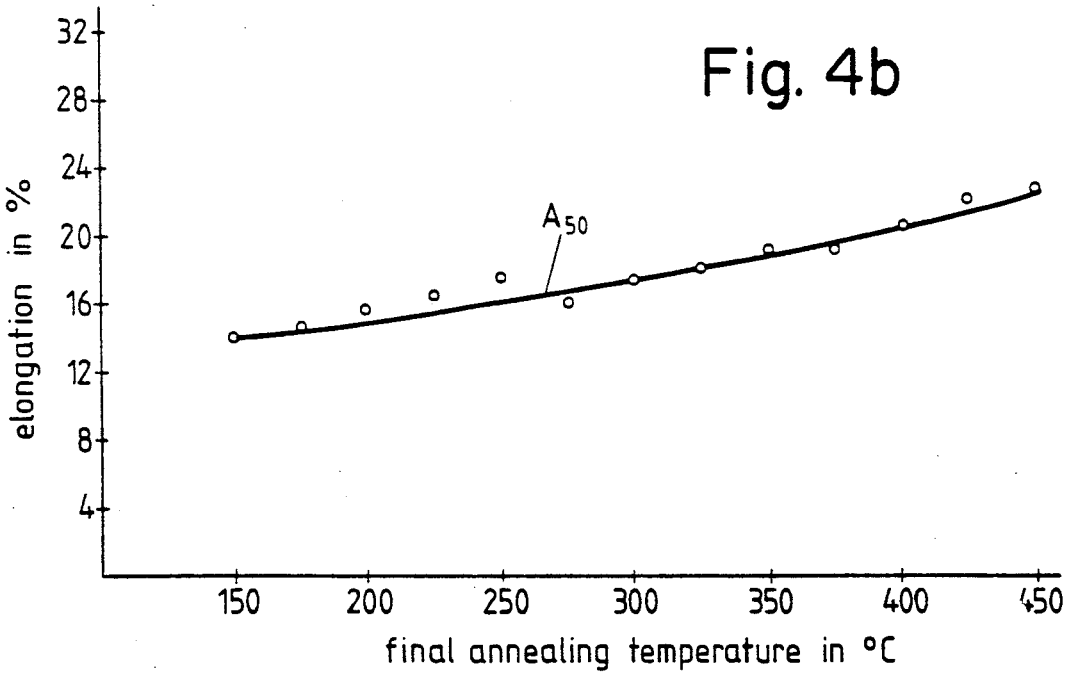
Figs. 4a&4b: Influence of final annealing temperature on the mechanical properties of cold deformed titanium, grade 2, hot rolled condition $R_m = 557$ N/qmm, $A_{50} = 27\%$.

PROCESS FOR ANNEALING COLD WORKING UNALLOYED TITANIUM

BACKGROUND OF THE INVENTION AND PRIOR ART

In the very recent past titanium and titanium alloys have come to play a more and more important part in technology. This is due to the outstanding technological properties of titanium materials, particularly their high resistance to corrosion and low specific gravity, which given the relatively high strength of titanium alloys, gives a weight saving of almost 40% compared with steel. Titanium and its alloys have therefore proved valuable particularly in aeronautical engineering and space travel, in chemical plant, power generation, marine technology and —owing to their good tolerance by the human body—in medical technology.

While unalloyed titanium is a ductile material with high elongation and reduction in area, its strength is increased quite considerably with increasing contents of alloying elements at the expense of ductility and formability; this applies particularly to oxygen, which brings about solution strengthening, and consequently four grades of unalloyed titanium are recognised in the art with oxygen contents of 0.05 to 0.35% and tensile strengths of 240 to 740 $N/mm^2$. The strength is however to a large extent dependent on temperature, and falls to about 50% even at a temperature of only 300° C.

Since titanium has a hexagonal crystal structure with fewer slip planes than the face-centred cubic or body-centred cubic crystal lattice, its resistance to deformation is so great that commercial $\alpha+\beta$-titanium alloys can hardly be cold-formed at all. Unalloyed titanium on the other hand is more or less cold-formable, depending on its oxygen content. However, increasing oxygen content and reduction lead to such pronounced cold-hardening that intermediate annealing becomes unavoidable. Thus for example after a 40% cold reduction the tensile strength is doubled while the elongation at fracture falls to one third. The elongation at fracture is then often only 5 to 10%. This is a great disadvantage since high surface quality and strength can only be obtained by way of cold forming, even at the expense of the ductility. Thus the unalloyed titanium with the lowest content of interstitial impurities of $\leqq 0.10\%$ oxygen (Werkstoff-Nr. 3.7025 according to DIN 17850) is still very easy to cold work. However, with an increasing proportion of foreign atoms, particularly oxygen, in the lattice, the cold formability is greatly reduced, so that heavy deformation is only possible with the use of repeated intermediate annealing in connection with a working cycle.

The intermediate annealing is usually performed either above the recrystallisation temperature (soft annealing at 600° to 800° C.) in order to restore the cold formability by forming new nuclei, or by a stress relieving heat treatment in the temperature range of from 500° to 600° C.

The cold forming is followed by a final heat treatment. Here the type and amount of the preceding cold work plays a decisive role. This gives rise to the possibility of obtaining a desired grain size in soft-annealing through the amount of reduction and the temperature and duration of the anneal.

According to DIN 65084 the final or soft annealing is usually performed—in dependence on the content of interstitial impurities in solution—above the recrystallisation temperature in the range of 600° to 800° C. and with a soaking time of 10 to 120 minutes.

If no recrystallisation is necessary, then according to DIN 65084 a stress relieving heat treatment is performed as an alternative as a final heat treatment in the temperature range 500° to 600° C. with a soaking time of 30 to 60 minutes.

Titanium and titanium alloys have already proved valuable in medical technology, for example as material for endoprotheses, jaw implants, bone plates, bone screws, bone needles, heart pacemaker cases and surgical instruments. Owing to its good strength properties the standard alloy TiA16V4 is outstanding. However the vanadium content of this alloy appears to cause problems, since elementary vanadium undergoes toxic reactions in the human body. While solution of the vanadium in the solid solution lattice reduces the danger of toxic reactions, this danger is not completely eliminated, particularly when friction and wear occur. Nickel-containing alloys should not be used either, since in individual cases there is then the danger of a nickel allergy. There is therefore a trend towards the use of vanadium-free titanium alloys, for example the specially developed implant alloy TiA15Fe2.5.

OBJECT OF THE INVENTION

It is an object of the invention to provide a cold-forming process that permits a combination of high strength and ductility to be obtained in unalloyed titanium, especially Grade 4 titanium, and in particular to increase the bendability.

SUMMARY OF THE INVENTION

According to the invention, in a process of the above-mentioned kind the intermediate annealing is performed below the recrystallisation temperature, preferably below 500° C., i.e. below the temperature used for stress-relief heat treatment.

The duration of the anneal is preferably from 30 minutes to some hours, and within this range the duration is inversely proportional to the annealing temperature.

The reduction can be from 10 to 90%, preferably 20 to 50%; in any given case it also determines the annealing temperature, since there is a relationship between reduction and annealing temperature in that lower reductions permit the use of higher annealing temperatures and higher reductions lower annealing temperatures, since the smaller the reduction, the higher is the recrystallisation temperature.

It is an essential feature of the process of the invention that the intermediate annealing takes place below the recrystallisation temperature, and preferably below the temperature for the stress-relieving heat treatment according to DIN 65084; nevertheless it leads, through a very uniform reduction in the dislocation density (as has been shown by electron micrographs) to a reduction in stress. The annealing according to the invention is typified by the absence of so-called cell structures, which are a sign of marked recovery.

The cold forming can be performed by drawing, roll forming, hammering, forging or rolling, for example using from 1 to 20, preferably 3 to 5 passes.

The cycle of cold working and intermediate annealing can be followed by a final heat treatment, for example tempering for from one to three hours below the recrystallisation temperature, preferably below 450° C., in order finally to adjust the strength and elongation and to improve the resistance to cracking.

An optimum combination of strength and ductility is obtained with the process of the invention if the iron content of the titanium does not exceed 0.08% and/or the oxygen content does not exceed 0.35%

BRIEF DESCRIPTION OF THE DRAWINGS

In the accompanying drawings:

FIGS. 1*a* to 3*b* show the effect of different cycles of cold rolling and annealing on the tensile strength and elongation of Grade 4 titanium, and FIGS. 4*a* and 4*b* shows the influence of the final annealing temperature on the mechanical properties of cold worked Grade 2 titanium.

More particularly,

FIGS. 1*a* and 1*b* relate to the rolling of Grade 4 Ti to a heat treatment; 17.5×5.2 mm profile with 4 intermediate anneals and a final teat treatment;

FIGS. 2*a* and 2*b* to the rolling of Grade 4 Ti to a 8.1×3.3 mm profile with 3 intermediate anneals and a final heat treatment;

FIGS. 3*a* and 3*b* to the drawing of a Grade 4 Ti wire to 8 mm diameter with 4 intermediate anneals, and a final heat treatment; and FIGS. 4*a* and 4*b* shows the effect of the temperature of the final heat treatment on the properties of cold-formed Grade 2 titanium having in the hot-rolled state $R_m$=557 N/mm² and $A_{50}$=27%.

DETAILED DESCRIPTION OF PREFERRED EMBODIMENTS OF THE INVENTION

The invention will now be described in more detail with reference to the accompanying drawings.

In a first test unalloyed Grade 4 titanium (Werkstoff Nr. 3.7065 according to Draft Standard DIN 17850) containing

| | |
|---|---|
| iron | 0.050% |
| oxygen | 0.32% |
| nitrogen | 0.005% |
| carbon | 0.03% |
| hydrogen | 0.0070% |
| balance titanium and incidental impurities | |

was first hot rolled to a wire having a diameter of 21 mm. This starting material was then cold worked with four intermediate anneals at 475° C., each with a duration of 3 hours, to a section of 17.5×5.2 mm, and then finally heat treated at 425° C. for two hours.

FIGS. 1*a* and 1*b* show the relationship between the tensile strength $R_m$ and elongation $A_{50}$ and the extent of deformation and number of working steps. In particular the broken lines in the diagram show how, between the two limiting lines for the tensile strength and elongation, during the intermediate anneals (vertical line sections) the tensile strength fell to the lower limiting line and the elongation rose to the upper limiting line, and during the following working step (sloping line sections) the tensile strength again increased up to the upper limiting line and the elongation fell again to the lower limiting line.

This is confirmed by two further examples for a profile of dimensions 8.1×3.1 mm (FIGS. 2*a* and 2*b*) and an 8 mm diameter wire (FIGS. 3*a* and 3*b*).

The diagrams of FIGS. 3*a* and 3*b* show very clearly the advantages that can be obtained by means of the present invention. The first cold working cycle with 28% reduction in area up to the first intermediate anneal increases the strength by 180 N/mm². The subsequent cold working with reductions in area of about 30% in each step and intermediate anneals between the steps led to a further increase in strength by 150 N/mm² to 1000 N/mm², i.e. by about 40 N/mm² per working cycle. With greater reductions and/or more frequent working and annealing cycles the strength can be increased to values above 1000 N/mm².

The elongation falls during the first cold forming cycle from an initial value of 33% to 18%, and on further working to 12%. However, by the intermediate annealing the elongation is again increased to 28 to 22%.

Depending on the intended use, any combination of strength and elongation between the two limiting lines can be obtained during the final heat treatment (last vertical section of the line). Higher annealing temperatures and/or longer annealing times lower the strength still further and correspondingly increase the elongation.

The diagrams of FIGS. 4*a* and 4*b* show the influence of the final heat treatment temperature on the mechanical properties of cold-worked Grade 2 titanium. This shows that, depending on the requirements, relatively low annealing temperatures can also be used in order to achieve the desired relation between proof stress, tensile strength and elongation.

The particular properties of material produced by the process of the invention show up particularly clearly in the case of bendability. The data from bend tests according to DIN 50111 on two different cold rolled profiles are collected in the following Tables I and II. These show, for a test duration of 1 minute, limiting values for the test conditions that lie at r=0.5×s, where r is the radius of the bending mandrel and s the thickness of the sheet.

According to DIN 17860 the minimum value for the radius of the bending mandrel is r=3×s for sheet thicknesses between 2 and 5 mm, The process of the invention thus yields a marked improvement in the bendability.

The unalloyed titanium cold rolled according to the invention is particularly suitable, in the form of plates, sheet, strip, wire and profiles for medical technology, for example for bone plates, bone screws, bone nails, tooth pins and tooth body anchorages, tooth replacements, heart pacemaker housings, heart valves, and protheses, and for medical instruments, parts of hearing aids, blood centrifuges and other medical devices.

Titanium treated according to the invention is however also suitable, owing to its high strength, ductility, bendability, good machinability, and corrosion resistance and its low specific gravity and modulus of elasticity, for other applications for which such a favourable combination of properties is required.

TABLE I

| Sample (17.5 × 5.2 mm) | Test conditions | Bending mandrel radius (mm) | Result |
|---|---|---|---|
| 1 | 3.1 × s | 16 | o.k. |
| 2 | 2.3 × s | 12 | o.k. |
| 3 | 1.9 × s | 10 | o.k. |
| 4 | 1.5 × s | 8 | o.k. |
| 5 | 1.0 × s | 5 | o.k. |
| 6 | 0.58 × s | 3 | o.k. |
| 7 | 0.48 × s | 2.5 | cracks at |

TABLE I-continued

| Sample (17.5 × 5.2 mm) | Test conditions | Bending mandrel radius (mm) | Result |
|---|---|---|---|
| | | | end of test |
| 8 | 0.48 × s | 2.5 | o.k. |
| 9 | 0.48 × s | 2.5 | o.k. |
| 10 | 0.48 × s | 2.5 | cracks at end of test |
| 11 | 0.58 × s | 3 | o.k. |

TABLE II

| Samples (13.5 × 4.2 mm) | Test conditions | Bending mandrel radius (mm) | Result |
|---|---|---|---|
| 21 | 0.71 × s | 3 | o.k. |
| 22 | 0.48 × s | 2 | o.k. |
| 23 | 0.48 × s | 2 | o.k. |
| 24 | 0.36 × s | 1.5 | o.k. |
| 25 | 0.36 × s | 1.5 | cracks at end of test. |

What is claimed is:

1. A process for forming a high strength highly ductile unalloyed titanium consisting of cold forming and intermediate annealing the titanium at a temperature below recrystallization temperature:

2. A process according to claim 1 wherein the annealing temperature does not exceed 500° C.

3. A process according to claim 1 wherein the duration of the annealing is from 30 minutes to 24 hours.

4. A process according to claim 1 wherein the reduction is from 10 to 90%.

5. A process according to claim 1 wherein the annealing temperature is up to 600° C. and the reduction is from 7 to 20%.

6. A process according to claim 1 wherein the annealing temperature is up to 500° C. and the reduction is from 20 to 90%.

7. A process according to claim 1 wherein the cold forming is performed at temperatures up to 600° C.

8. A process according to claim 1 wherein between the individual intermediate anneals the material is cold formed using from 1 to 20 passes.

9. A process according to claim 1 wherein from 1 to 20 intermediate anneals are performed after the cold forming.

10. A process according to claim 1 which includes a final heat treatment below the recrystallization temperature.

11. A process according to claim 1 wherein an unalloyed titanium in which the content of at least one of oxygen and iron is not more than 0.35% and 0.08% respectively is cold formed and intermediate annealed.

12. A process according to claim 4 wherein the reduction is from 20 to 50%.

13. A process according to claim 8 wherein between the individual intermediate anneals the material is cold formed using from 3 to 10 passes.

14. A process according to claim 9 wherein from 2 to 5 intermediate anneals are performed after the cold forming.

15. A process according to claim 10 wherein the temperature of the final heat treatment is below 450° C.

* * * * *